US005622097A

United States Patent [19]

Martensen et al.

[11] Patent Number: 5,622,097

[45] Date of Patent: Apr. 22, 1997

[54] HYDRAULIC PISTON MACHINE

[75] Inventors: Lars Martensen, Sønderborg; Ove T. Hansen, Nordborg, both of Denmark

[73] Assignee: Danfoss A/S, Nordborg, Denmark

[21] Appl. No.: 464,691

[22] PCT Filed: Jan. 3, 1994

[86] PCT No.: PCT/DK94/00001

§ 371 Date: Jun. 6, 1995

§ 102(e) Date: Jun. 6, 1995

[87] PCT Pub. No.: WO94/16218

PCT Pub. Date: Jul. 21, 1994

[30] Foreign Application Priority Data

Jan. 18, 1993 [DE] Germany ..... 43 01 133.0

[51] Int. Cl.[6] ..... F01B 13/04

[52] U.S. Cl. ..... 92/57; 92/71; 91/499; 74/60

[58] Field of Search ..... 92/57, 71, 170.1; 91/499; 417/269; 74/60

[56] References Cited

U.S. PATENT DOCUMENTS 4,014,250 3/1977 Bosch ..... 92/57

4,799,419 1/1989 Krause ..... 92/57

4,911,614 3/1990 Kawai et al. ..... 417/269

*Primary Examiner*—Thomas E. Denion

*Attorney, Agent, or Firm*—Lee, Mann, Smith, McWilliams, Sweeney & Ohlson

[57] ABSTRACT

A hydraulic piston machine is proposed, with a cylinder body (1), which comprises at least one cylinder (2) with a piston (3) movable therein, and a control counter-plate (7) which engages the cylinder body (1) by way of a contact surface (6) and, on relative movement between the cylinder body and the control counter-plate parallel to the contact surface, connects the cylinder in dependence upon its position with inlet and outlet channels (11, 12) respectively, the control counter-plate (7) and/or the cylinder body (1) being provided, at least in the region of the contact surface (6, 9), with a friction-reducing layer (13). A machine of that kind should be inexpensive to manufacture yet should operate reliably even when the hydraulic fluid has no or only slight lubricating properties. For that purpose the friction-reducing layer (13) is in the form of an injection-moulded part.

8 Claims, 2 Drawing Sheets

HYDRAULIC PISTON MACHINE

Figure 1:
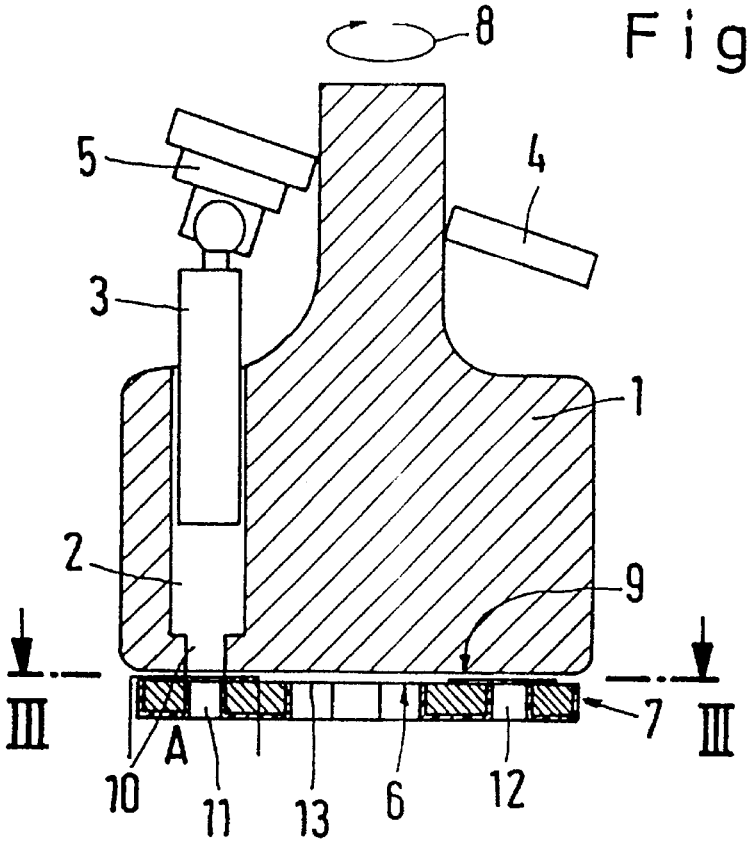

The invention relates to a hydraulic piston machine with a cylinder body, which comprises at least one cylinder with a piston movable therein, and a control counter-plate which engages the cylinder body by way of a contact surface and, on relative movement between the cylinder body and the control counter-plate parallel to the contact surface, connects the cylinder in dependence upon its position with inlet and outlet channels respectively, the control counter-plate and/or the cylinder body being provided, at least in the region of the contact surface, with a friction-reducing layer of plastics material.

In piston pumps, as known, for example from DE-AS 12 67 985, the cylinder body has to be pressed with a relatively strong pressure against the control counter-plate in order to keep the transition from the cylinders to the control counter-plate as well-sealed as possible. The larger are the unsealed areas in this region, the greater is the leakage, which has an adverse effect on the volumetric efficiency of the machine. Because of the high pressure, considerable frictional forces act on the contact surface and, without supplementary measures, lead relatively quickly to wear and tear or even to destruction of the machine. This phenomenon can be partially counteracted by lubricating the contact surface to reduce friction. The hydraulic fluid is used for that purpose. This presupposes, however, that the hydraulic fluid has satisfactory lubricating properties. This requirement considerably restricts the group of hydraulic fluids that can be used. Fluids which have satisfactory lubricating properties are in many cases harmful from the point of view of their impact on the environment, especially in so far as synthetic oils are concerned.

For that reason, in a machine of the kind mentioned in the introduction, which is intended for use for water, it is known (JP 2-125 979) to arrange between the control counter-plate and the cylinder body a plastics material layer which is adhesively secured to the roughened contact surface. A number of manufacturing steps are required for this, however. It is also not always possible to ensure that the plastics material layer is reliably fixed to the cylinder body or to the control counter-plate. In particular, there is a danger that hydraulic fluid under pressure will get between the plastics material layer and the control counter-plate or cylinder body and detach the layer at least partially. This leads very rapidly to serious damage to the machine.

From DE 16 53 529 B2 it is furthermore known to provide a control control counter-plate disc with inserts of carbon, which are in the form of linear strips, to reduce the friction between the cylinder body and the control counter-plate disc. Here, however, it is difficult to keep the control counter-plate and the end face of the cylinder body close enough to one another, so that considerable leakage can occur here.

The invention is therefore based on the problem of providing a hydraulic piston machine that is inexpensive to manufacture and which can be operated reliably even with hydraulic fluids that have few or no lubricating properties.

This problem is solved in a hydraulic piston machine of the kind mentioned in the introduction in that the friction-reducing layer is in the form of an injection-moulded part.

Injection moulding on the one hand enables relatively thin layers to be achieved which can, on the other hand, be fixed securely to the part carrying them. This simplifies manufacture quite considerably, especially when the layer is produced "in situ", that is, is injected directly onto the cylinder body or the control counter-plate. The function of "lubrication" is transferred to a machine element, namely to the friction-reducing layer, which forms a surface layer in the region of the contact surface. Combinations of materials are known which are able to slide on one another with relatively little friction even under relatively large pressures. Through suitable selection of the material for the layer, taking into account the material of the control counter-plate or the cylinder body which rubs on this layer in the region of the contact surface, friction in the region of the contact surface can therefore be markedly reduced, without the need for a lubricating fluid to be supplied. Since the layer is only a thin injection-moulded layer, however, the mechanical properties of the machine are otherwise unaffected, or not affected to an appreciable extent. The stability and thus the load rating in particular remain virtually unchanged. The limitation to one layer also enables previously used components to be used virtually unchanged. Since the friction-reducing material is applied only in the form of a layer, there is practically no risk of the geometry of the cylinder body or the control counter-plate undergoing changes because of increases or decreases in temperature. Injection-coating or injection-moulding produces a connection of the plastics material with its corresponding counter-part that is substantially more intimate than that produced by use of adhesive. The plastics material of the injection-moulded layer can be selected in dependence upon the material which rubs against the friction-reducing layer. Suitable combinations of materials enable coefficients of friction that are entirely comparable with the values of a fluid-lubricated contact surface or even exceed these to be achieved. Examples of plastics materials which may be considered for the injection-moulded part are, in particular, materials from the group of high-strength thermoplastic plastics materials on the basis of polyaryl ether ketones, in particular polyether ether ketones, polyamides, polyacetals, polyaryl ethers, polyethylene terephthalates, polyphenylene sulphides, polysulphones, polyether sulphones, polyether imides, polyamide imide, polyacrylates, phenol resins, such as novolak resins, or similar substances, and as fillers, use can be made of glass, graphite, polytetrafluoroethylene or carbon, in particular in fibre form. When using such materials, it is likewise possible to use water as the hydraulic fluid.

Surface structures in the form of channels and other recesses are preferably provided in the friction-reducing layer. Previously, these surface structures had to be produced by a mechanical machining operation on the corresponding contact surface, for example by milling or a different machining process. Now, however, the surface structures can be incorporated directly in the friction-reducing layer, for example, by producing them directly during moulding. For this purpose it is merely necessary for the moulding tool to have a corresponding negative form in the region of the contact surface. Since a machining step, which is relatively time-consuming, can consequently be omitted, production costs can be considerably reduced. Moreover, it is likewise possible to produce more precise structures, which could be produced only with difficulty by secondary mechanical machining.

The friction-reducing layer is preferably provided on the control counter-plate, the control counter-plate having continuous openings and the layer extending right through the continuous openings. The layer, which is of integral form in the region of the contact surface and in the region of the continuous openings, now has, as it were, a holding element, which is able to accommodate forces that act parallel to the contact surface, for example the frictional forces. The friction-reducing layer is accordingly held reliably in place on the control counter-plate.

The cylinder body preferably has a pressure plate on the side facing the control counter-plate, the pressure plate having for each cylinder a continuous bore, which is connected to the cylinder by way of a bush that is axially movable in the cylinder and/or the continuous bore, the pressure plate engaging the cylinder body by way of a compression spring. The contact surface is therefore here formed between pressure plate and control counter-plate. Since the friction-reducing layer allows much higher pressure forces than previously to act on the contact surface, this measure has the advantage that these pressure forces are kept away from the cylinder which is generally lined with a bushing. The force that presses the pressure plate and the control counter-plate against one another is essentially applied by way of the compression spring. Because the bushes are able to move axially, even with the small movements that may occur it is possible to ensure that a connection between the cylinder and the continuous bore is maintained. Frictional forces which can act on the bush are largely accommodated by the pressure plate. It therefore becomes easier to balance out the co-operation between the pressure plate and control counter-plate, that is, to effect an equilibrium between the forces produced by the compression spring and the forces produced by relief of hydrostatic pressure at the contact surface.

Advantageously, provision is made for the part having the friction-reducing layer to be surrounded on all sides, at least in the pressure region, by plastics material. There are then no gaps between the part and the plastics material layer through which hydraulic fluid could penetrate and cause damage. Perforations in the plastics material layer produced by fixing the corresponding part in the injection mould can be sealed subsequently. It is easier, however, to arrange these perforations in a region not acted on by pressure. Simple wetting, that is, pressureless wetting of the layer, cannot then lead to the hydraulic fluid penetrating between the layer and the part.

Advantageously, the control counter-plate has a low-pressure "kidney" which, at its end over which an opening passes first, has a groove which produces a directed jet at least immediately after the start of coincidence with the opening, wherein the distance between the start of the groove and a projected point of impact of the jet on a wall of the low-pressure kidney is greater than 3.5 times the width of the low-pressure kidney. When the opening, which may also be formed by the continuous bore, coincides with the low-pressure kidney, initially a very small opening appears which enlarges very quickly but at the beginning discharges the hydraulic fluid still in the cylinder in a very fine jet at great pressure. This is less inconvenient if the hydraulic fluid is an oil, because oil is relatively "soft". If water is being used as hydraulic fluid, however, this jet, which is extraordinarily fierce, results very rapidly in destruction of the plastics material layer and subsequently of the control counter-plate, because water is relatively "hard", namely, about two to five times harder than oil. To prevent such damage, the jet is directed so that it has to cover as long as possible a path within the hydraulic fluid. In this connection, it is fanned out and is braked so that a fierce jet of fluid no longer strikes the wall. On the contrary, it is only a flow that is produced, which no longer causes erosion.

The invention also relates to a method for manufacturing such a machine, in which the friction-reducing layer is produced by moulding, in particular by injection-moulding. The friction-reducing layer can be applied relatively thinly, but with the required accuracy, by the moulding or injection-moulding. If the layer is moulded directly onto the part, a very durable bond is produced.

In this connection, the surface structures are preferably produced during moulding through suitable shaping of the mould. Subsequent mechanical machining is largely avoided by this measure.

In this connection, it is especially preferred for the contact surface to be produced after moulding by surface grinding of protruding projections in the region of their ends. Although the geometry of the contact surface can to a large extent be shaped with a high degree of accuracy by the moulding, it is easier to bring the ends of all projections into one plane by surface-grinding after moulding than it is to shape the moulding tool so that the required accuracy is guaranteed.

Figure 2:
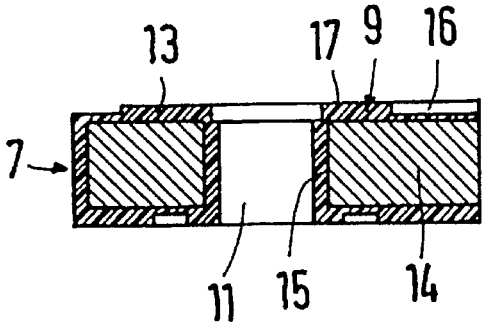
Figure 3:
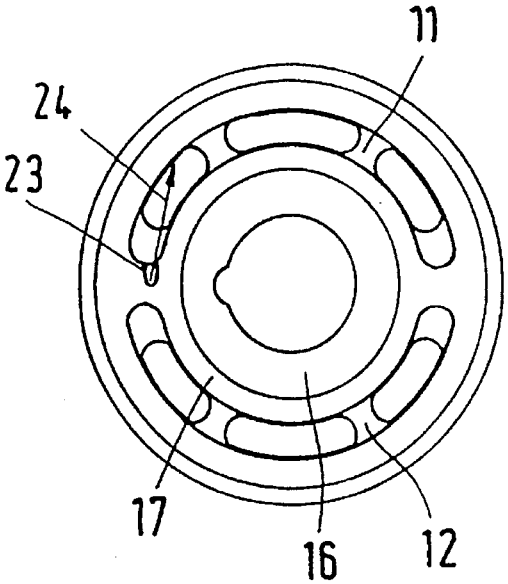
Figure 4:
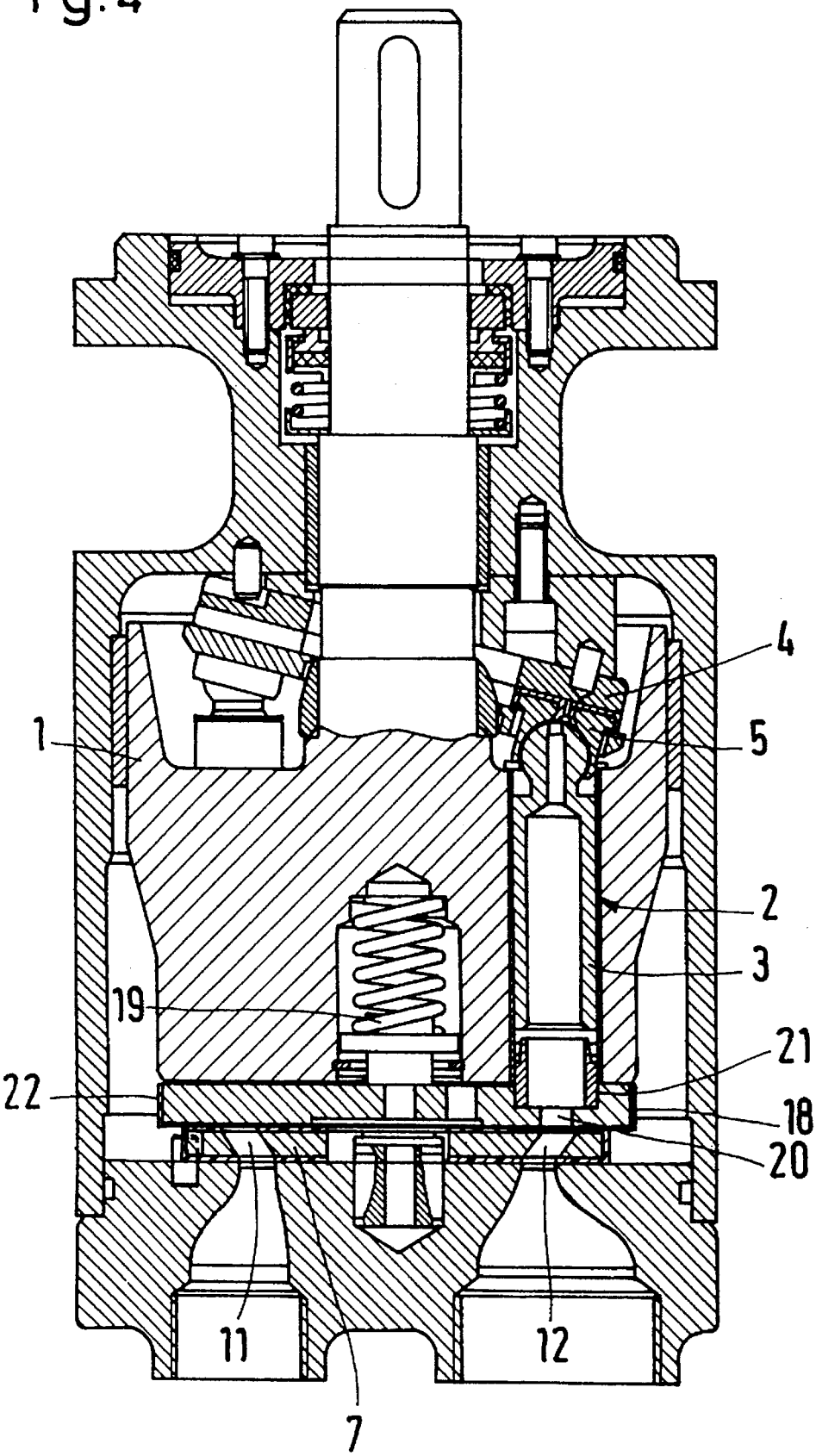

The invention is described hereinafter with reference to preferred embodiments in conjunction with the drawing, in which FIG. 1 shows a diagrammatic cross-section through a part of a piston machine according to a first embodiment, FIG. 2 shows a detail view A corresponding to FIG. 1, FIG. 3 shows a section III—III corresponding to FIG. 1, and FIG. 4 shows a section according to a second embodiment.

A hydraulic machine has a cylinder body 1 in which at least one cylinder 2 is arranged. A piston 3 is arranged to move up and down in the cylinder 2. The movement of the piston 3 is controlled by a slanting plate 4 against which the piston 3 lies via the intermediary of a slider shoe 5.

The opposite end of the cylinder body 1, that is, the side from which the piston 3 does not project, has a contact surface 6 with by means of which the cylinder body 1 lies on a control counter-plate 7. If the cylinder body 1 is rotated in the direction of arrow 8, the contact surface 6 of the cylinder body 1 slides over an opposing contact surface 9 of the control counter-plate 7. On each rotation of the cylinder body 1, an opening 10 in the cylinder coincides alternately with an intake bore 11 and a pressure bore 12 in the control counter-plate, which are connected to an intake connection and a pressure connection, respectively, not illustrated more precisely. If the machine is used as a motor, the intake bore 11 is connected to a pressure connection, whilst the pressure bore 12 is connected to a tank connection. During an upward movement of the piston 3 in the cylinder 2 hydraulic fluid is therefore delivered into the cylinder 2, whereas during a downward movement the hydraulic fluid is expelled from the cylinder 2.

So that the hydraulic fluid uses only the assigned route, that is to say, passes only through the intake bore 11 and the pressure bore 12, it is necessary for the remaining regions of the contact surfaces 6, 9 to seal off this fluid route. The cylinder body 1 and the control counter-plate 7 therefore have to engage one another under a certain pressure.

This pressure causes the frictional forces in the contact surfaces 6, 9 to increase, however. Lubrication using fluid was previously used to reduce friction, with the hydraulic fluid acting as the lubricant.

So that hydraulic fluids which have no lubricating properties can also be used, the control counter-plate 7 is provided at least in the region of the contact surface 9 with a friction-reducing layer 13. This friction-reducing layer is formed from a plastics material, for example nylon or another polyamide, polytetrafluoroethylene (PTFE) or polyaryl ether ketone, such as polyether ether ketone (PEEK). For that purpose the control counter-plate 7 has a core 14 which, as in previous control counter-plates, can be formed from metal. The core 14 is then coated in an injection-moulding process with the friction-reducing layer 13 in such a way that the intake bore 11 and the pressure bore 12, which are also in the form of continuous openings, are also lined with the layer 13. This results in the layer 13 being provided integrally with holding elements 15 which project at right angles to the contact surface 9 and are able to accommodate forces that act approximately parallel to the contact surface 9. Because the core 14 is completely encased by the friction-reducing layer 13, there are no gaps through which hydraulic fluid could penetrate between the core 14 and the layer 13. The control counter-plate 7 can therefore also be used at high pressures. Perforations in the layer 13, which can result from fixing the core 14 in an injection mould, are arranged so that they can be wetted only by pressureless hydraulic fluid.

Surface structures in the form of recesses 16 and projections 17 are worked in the contact surface 9. These surface structures 16, 17 can be created during moulding around the core 14 if the mould has corresponding negative shaping. Subsequent machining of the control counter-plate 7 can then largely be dispensed with. It is merely necessary to bring all the outwardly projecting ends of the projections 17 together into one plane. This can be effected, for example, by surface grinding.

The friction-reducing layer may, of course, be equally well provided on the contact surface 6 of the cylinder body 1. In that case, provision can also be made for it to enclose the cylinder body 1 completely.

As is apparent from FIG. 3, the intake connection 11, which is here in the form of a low-pressure kidney, has a groove 23 at its commencement. If the cylinder body 1 is rotated in a clockwise direction, the opening 10 of the cylinder 2 coincides with the groove 23 of the low-pressure kidney 11. Because there is always a certain residual pressure from the high pressure side still in the cylinder 2, the hydraulic fluid escapes at that instant through the gap formed between the groove 23 and the opening 10 at a relatively high pressure in a powerful jet 24. To moderate the effects of this jet, the jet 24 is directed, which can be achieved relatively easily by suitable shaping of the groove 23. The jet 24 is hereby directed so that it does not meet the wall of the low-pressure kidney 11 until it has covered a path that is at least 3.5 times the width of the low-pressure kidney 11. The jet 24, or more accurately, the fluid moved in it, therefore has to cover a relatively long route within the hydraulic fluid, during which it is braked by the surrounding hydraulic fluid. The jet 24 is fanned out and thus loses its intensity.

FIG. 4 shows a further construction, in which the cylinder body 1 additionally has a pressure plate 18 which bears against the cylinder body 1 by way of a compression spring 19. The pressure plate 18 has continuous bores 20 which can be caused to coincide with the intake bore 11 and the pressure bore 12 respectively as the cylinder body 1 rotates. Bushes 21 which are mounted so as to be axially displaceable in the cylinder 2 and in the pressure plate 18 are let into the pressure plate 18. The bushes 21 guarantee a reliable, that is to say, tightly sealed fluid connection even when the cylinder body 1 and the pressure plate 18 move axially relative to one another. Such a movement is possible by virtue of the compression spring 19. It is, however, of only small extent.

In this construction, the pressure plate 18 is sheathed with a friction-reducing layer which is also led through the continuous bore 20. The pressure plate 18 is therefore completely surrounded by the plastics material forming the friction-reducing layer 22.

As is apparent, the friction-reducing layer 13, 22 is very thin. After the control counter-plate 7 and the pressure plate 18 have been coated, these two parts have approximately the same thickness as before. They are therefore by and large mechanically just as strong as a part made exclusively of metal. On account of the friction-reducing layer, however, the cylinder body 1 and the control counter-plate 7 can be pressed against one another harder, that is to say, with greater force, than previously, with the result that leakage is reduced and efficiency is increased without the mechanical performance being adversely affected by higher frictional forces.

Coating of the control counter-plate 7 produces the advantage that hydraulic fluid is unable to penetrate into the gaps between the layer 13 and the core 14, which could destroy the plastics material. Because the continuous bores 11, 12 also are lined with the plastics material, the plastics material can be regarded here as a tubular connection which guides the hydraulic fluid from a stationary part, namely, the control counter-plate 7, to a rotating part, namely the cylinder body 1.

The present embodiment is illustrated as an axial piston machine, which can be used both as a motor and as a pump. It is, however, equally possible for the friction-reducing layer to be incorporated in corresponding parts of a radial piston machine.

We claim:

1. A hydraulic piston machine having a cylinder body and at least one cylinder with a piston movable therein, a control counter-plate which engages the cylinder body by way of a contact surface and, on relative movement between the cylinder body and the control counter-plate parallel to the contact surface, connects the cylinder in dependence upon its position with inlet and outlet channels respectively, at least one of the control counter-plate and the cylinder body being provided, at least proximate the contact surface, with a friction-reducing layer of plastic material, and in which the friction-reducing layer is in the form of an injection-moulded part.

2. A machine according to claim 1, in which surface structures in the form of channels and recesses are provided in the friction-reducing layer.

3. A machine according to claim 2, in which the friction-reducing layer is provided on the control counter-plate, the control counter-plate having continuous openings and the layer extending through the continuous openings.

4. A machine according to claim 1, in which the cylinder body has a pressure plate on a side facing the control counter-plate, the pressure plate having for each cylinder a continuous bore which is connected to the cylinder by way of a bush that is axially movable in at least one of the cylinder and the continuous bore, the pressure plate engaging the cylinder body via the intermediary of a compression spring.

5. A machine according to claim 1 in which one of said control counter-plate and said cylinder body has the friction-reducing layer surrounded on all sides, at least in a pressure region, by plastic material.

6. A machine according to claim 1, in which the control counter-plate has a low-pressure kidney which, at its end over which an opening passes first, has a groove which produces a directed jet at least immediately after the start of coincidence with the opening, wherein the distance between the start of the groove and a projected point of impact of the jet on a wall of the low-pressure kidney is greater than 3.5 times the width of the low-pressure kidney.

7. A method for manufacturing the hydraulic machine defined by claim 2, in which the surface structures are produced during moulding through suitable shaping of the mould.

8. A method for manufacturing the hydraulic machine defined by claim 7, in which the contact surface is produced after moulding by surface grinding of protruding projections in the region of ends of the projections.

* * * * *